United States Patent [19]

Givens et al.

[11] 4,400,261

[45] Aug. 23, 1983

[54] PROCESS FOR COAL LIQUEFACTION BY SEPARATION OF ENTRAINED GASES FROM SLURRY EXITING STAGED DISSOLVERS

[75] Inventors: Edwin N. Givens, Bethlehem; David H. S. Ying, Macungie, both of Pa.

[73] Assignee: International Coal Refining Company, Allentown, Pa.

[21] Appl. No.: 308,724

[22] Filed: Oct. 5, 1981

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,644,192 | 2/1972 | Li et al. | 208/8 LE |
| 4,123,347 | 10/1978 | Maa | 208/8 LE |
| 4,189,371 | 2/1980 | Moo et al. | 208/8 LE |
| 4,283,267 | 8/1981 | Maa et al. | 208/8 LE |
| 4,300,996 | 11/1981 | Kuehler | 208/8 LE X |
| 4,313,816 | 2/1982 | Voluswamy et al. | 208/8 LE X |
| 4,325,800 | 4/1982 | Rosenthal et al. | 208/8 LE |

*Primary Examiner*—Delbert E. Gantz
*Assistant Examiner*—William G. Wright
*Attorney, Agent, or Firm*—Mark F. Wachter

[57] ABSTRACT

There is described an improved liquefaction process by which coal is converted to a low ash and low sulfur carbonaceous material that can be used as a fuel in an environmentally acceptable manner without costly gas scrubbing equipment. In the process, coal is slurried with a solvent, passed through a preheater and at least two dissolvers in series in the presence of hydrogen-rich gases at elevated temperatures and pressures. Solids, including mineral ash and unconverted coal macerals are separated from the condensed dissolver effluent. In accordance with the improved process, fresh hydrogen is fed to each dissolver and the entrained gas from each dissolver is separated from the slurry phase and removed from the reactor system before the condensed phase is passed to the next dissolver in the series. In accordance with another process, the feeds to the dissolvers are such that the top of each downstream dissolver is used as a gas-liquid separator.

12 Claims, 5 Drawing Figures

PROCESS FOR COAL LIQUEFACTION BY SEPARATION OF ENTRAINED GASES FROM SLURRY EXITING STAGED DISSOLVERS

The Government of the United States of America has rights to this invention pursuant to Contract No. DE-AC05-780R03054 (as modified) awarded by the U.S. Department of Energy.

BACKGROUND OF THE INVENTION

This invention relates to a process for the solvent refining of coal wherein coal is liquefied by subjecting it to a hydrogen donor solvent (hereinafter referred to as "solvent") in the presence of a hydrogen-rich gas at elevated temperatures and pressures. This process is referred to in the art as SRC-I, solvent refined coal having the acronym "SRC". In this process, following solvation, the products are separated into gaseous material, distillate fractions and vacuum distillation bottoms. The vacuum distillation bottoms, which contain entrained mineral matter and unconverted coal macerals, are separated in a deashing step. From the solids removal step there is recovered a stream of coal products which are free of ash minerals and unconverted coal and which are essentially low in sulfur content, such that this material is ideally suited for combustion in environmentally acceptable operations.

In the operation of a coal liquefaction complex for the process of the above-indicated type, the dissolving section must be capable of generating sufficient process solvents to meet the solvent demands of the plant. Not only must adequate supplies be met, but also the quality of this solvent must be kept at a level such that the process will continue to operate.

The SRC-I pilot plants at Wilsonville, Ala. and Fort Lewis, Wash. have been operated only with a single coal liquefaction reactor (also known as the dissolver) preceded by a preheater. The coal liquefaction reactions take place to some extent in both of these vessels. A slurry of coal in recycled solvent under hydrogen pressure is passed through the preheater, where its temperature is raised from ambient to temperatures up to 800° F. For a typical dissolver outlet temperature of 825° F., the preheater outlet temperature would be about 775° F. The residence time in the preheater is about five minutes. About 85% of the raw coal is dissolved at the preheater exit, but other reactions (desulfurization, solvent production, etc.) do not occur to any major extent in the preheater. The heated slurry then passes to the dissolver, where the bulk of the other liquefaction reactions (desulfurization, solvent production, solvent rehydrogenation, etc.) take place.

SUMMARY OF THE INVENTION

It is the general object of the invention to provide a solvent refined coal process of the indicated type wherein the slurry coal feed is passed sequentially through a series of dissolvers with fresh hydrogen being fed to each dissolver. The entrained gas from each dissolver is separated from the slurry phase and removed from the reactor system before the condensed phase is passed through a downstream dissolver.

There are additional significant advantages of the process in accordance with the invention. The design allows an adequate velocity of solids through the system so that the solids do not settle out or accumulate in the suspended state beyond a workable level. Likewise the gaseous void volume in the reactor is sufficient to permit adequate hydrogen transfer from the gaseous phase to the reacting condensed phase. This recognizes that interfacial hydrogen contact is exceedingly important in supplying sufficient hydrogen to the reaction.

In accordance with the process of the invention in which the coal slurry is fed through a series of dissolvers, the feed gas, unlike the slurry phase, is fed to the series of dissolvers in parallel such that the gaseous feed to each dissolver is sufficient to maintain a void volume of at least 6% but less than 15% in each dissolver. More preferably, a range of 8–12% should be utilized.

In accordance with one embodiment of the invention, the effluent streams from each dissolver are passed into a gas separator to allow the gaseous product and volatilized solvent to pass overhead to a product workup area. The condensed underflow from the separator is passed immediately into the next dissolver in the presence of a fresh stream of fresh hydrogen-rich gas.

Since hydrogenation is a function of hydrogen purity in the gaseous phase, the step of feeding fresh hydrogen into each dissolver accomplishes the following advantageous results:

(1) The partial pressure of hydrogen in the flowing gas stream is increased because of the absence of gaseous hydrocarbons and water.

(2) The large quantity of water produced from the coal is passed overhead away from contact with the downstream reactor, especially since most of the water is produced in the early stages of the reaction.

(3) The partial pressure of $H_2S$ in the gaseous stream is reduced which will promote desulfurization in downstream dissolvers.

(4) Optimum interfacial hydrogen contact is maintained by operating at void volumes between 8 and 12% while operating at high linear liquid rates.

The term "void volume" as used herein denotes the contained gaseous volume of a dissolver above the level of the condensed phase excluding foam.

DETAILED DESCRIPTION OF THE PREFERRED EMBODIMENTS

Figure 1:
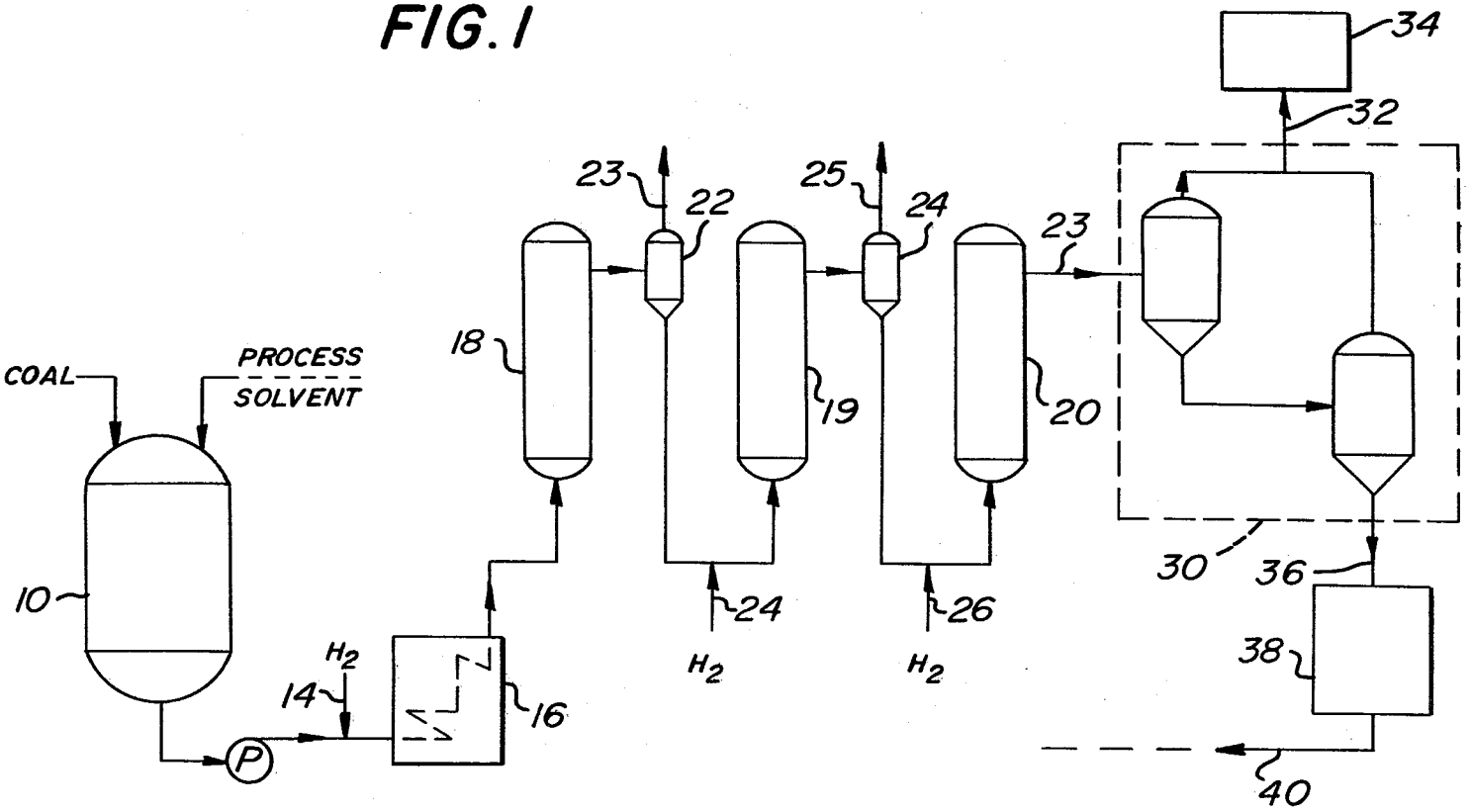
FIG. 1 is a schematic flow diagram of one embodiment of the invention.

Feed coal to this process may be of any rank lower than anthracite, such as bituminous, sub-bituminous or lignite coals or mixtures thereof. The feed coal may be used directly from the mine (run-of-mine coal), or may be precleaned to any of several levels to remove a portion of the entrained mineral matter. The coal, either run-of-mine or from a coal preparation plant, may be ground to a size typically less than 8 mesh (Tyler Screen Classification), or more preferentially less than 20 mesh, and dried to remove substantial moisture to a level for bituminous or sub-bituminous coals of less than 4 weight percent.

In this process coal is slurried with a solvent which may be comprised of a coal-derived oil, obtained in the coking of coals in a slot oven, commonly referred to as creosote oil, anthracene oil, or of equivalent type, or it may be a process-derived solvent. Also contained in this solvent may be a residual SRC production fraction taken from a solids separation step such as from the second stage separation of a critical solvent deashing unit which can be employed if so desired. The fraction of the residual SRC in the solvent stream may be up to 35 percent of the total solvent.

The coal is mixed with the process solvent in a coal slurry mix tank 10 at temperatures from ambient to 450° F. and concentrations of coal in the slurry of 20–55% by weight. In the slurry mix tank 10, which may be maintained at elevated temperatures to keep the viscosity of the solvent low enough to pump, a portion of the moisture entrained in the feed coal will be removed. Maintaining the tank at higher temperatures will allow moisture to escape as steam. The slurry from tank 10 to a pumping unit 12 that forces the slurry into a system which is maintained at higher pressures usually from 500 to 3000 psig. The slurry is mixed with a hydrogen-rich gaseous stream, via line 14, at a ratio of from 10–40 Mscf per ton of feed coal. The three-phase gas/slurry stream is then introduced into a preheater system comprised of a tubular reactor 16 having a length to diameter ratio greater than 200, and more preferably, greater than 500. The temperature of the three-phase mixture is increased from the appropriate temperature in the slurry tank to an exit temperature of 600°–850° F.

The preheated slurry is then passed to a coal liquefaction stage whereat the slurry is passed in series through a plurality of dissolvers. In FIG. 1, three dissolvers are shown and comprise tubular vessels 18, 19 and 20 operated in an adiabatic mode without the addition of significant external heat. The length to diameter ratios of these dissolver vessels 18, 19 and 20 are considerably less than employed in the preheater section of this process. The exit slurry from the preheater section contains little undissolved coal which thereby enters the first dissolver vessel 18. In the preheater section, viscosity of the slurry changes as the slurry flows through the tube, forming initially a gel-like material which shortly thereafter diminishes sharply in viscosity to a relatively freely flowing fluid. This fluid then enters the dissolvers where other changes occur.

In the dissolvers the coal and solvent undergo a number of chemical transformations including, but not necessarily limited to, further dissolution of the coal; hydrogen transfer from the solvent to the coal; rehydrogenation of recycled solvent; removal of heteroatoms, including sulfur, nitrogen, and oxygen, from the coal and recycle solvent; reduction of certain components in the coal ash, e.g., $FeS_2$ to FeS; and hydrocracking of heavy coal liquids. The mineral matter in the coal can, in various extent, catalyze the above reactions.

The superficial flows of the gas and slurry phases are chosen to maintain good agitation within the reactor (dissolver) which insures good mixing. The ratio of total hydrogen gas to slurry is maintained at a level to insure an adequate hydrogen concentration in the exit slurry to prevent coking. Specific selection of flow through the dissolvers is chosen such that the coal slurry with its incipient mineral particles moves through the dissolvers with minimal entrainment of larger particles that are unable to exit the dissolvers. The quantity of solids that accumulate in the dissolvers at these velocities is quite small based on feed. In the preferred design, the concentration of solids in the dissolvers will serve to catalyze the reactions. Because of this inherent accumulation phenomemon, it is desirable that a solids withdrawal system be placed into the dissolvers so that excessive accumulated solids can be removed from the system.

The effluent from the first dissolver vessel 18 is fed to a gas separator 22 where the effluent is flashed to a gas system where ultimately the vapors are cooled and let down in pressure to recover the light gases, water and organic rich condensate. These separations, collections and gas purification separations are accomplished in a gas treatment area where the overhead from the separator 22 is combined with the overhead from the other separators and from the separator at the terminous of the process. The overhead from separator 22 is delivered to the gas treatment area by way of line 23.

The underflow from separator 22 is passed to the second dissolver vessel 19 whereat the slurry being transferred is remixed with fresh hydrogen by way of line 24 prior to injection into the second dissolver vessel 19. Adequate hydrogen is fed to the second dissolver vessel 19 to maintain good agitation in the dissolver vessel to insure good mixing. Introducing fresh hydrogen to the second dissolver increases the hydrogen partial pressure significantly since much of the CO, $CO_2$ and $H_2O$ was removed after the first dissolver by means of the gas separator 22. The high partial pressure will insure better reaction promoting higher conversion of the residual fractions to distillate and better hydrogen incorporation into the solvent. The higher partial pressure of hydrogen will also promote sulfur removal.

The number of dissolvers in the process may be two or more. The concentration of higher boiling point material in the downstream dissolvers will be greater than in the first dissolver. With this higher concentration of the residual material comes the capability of selectively treating this fraction to produce a greater amount of distillate.

The effluent from the second dissolver vessel 19 is fed to a gas separator 24 which is constructed and functions in the same manner as gas separator 22 whereby the effluent is flashed to a gas system where ultimately the vapors are cooled and let down in pressure to recover the light gases, water and organic condensates. The underflow from gas separator 24 is passed to the third dissolver 20 as shown in FIG. 1. During this transfer, the slurry is remixed with fresh hydrogen by way of line 26 and the mixture is injected into the third dissolver 20. Again, adequate hydrogen is fed through line 26 to maintain good agitation in dissolver vessel 20 to insure good mixing and, as in the case of dissolver vessel 19, the introduction of fresh hydrogen increases the hydrogen partial pressure significantly.

The dissolver contents from the third or final dissolver are removed, fed through line 28 into a vapor/liquid separating zone, indicated at 30, where the effluent is flashed and the overhead is cooled to a range of 100°–150° F. in heat exchangers which may be in multiple stages, all which are well known in the art. Light gases, e.g., hydrogen, $H_2S$, $CO_2$, ammonia, $H_2O$ and $C_1$–$C_4$ hydrocarbons are removed in the flashing operation and pass via line 32 to a hydrogen recovery section 34 whereat these gases are scrubbed to remove acidic and alkaline components, while the hydrogen and lower hydrocarbons may be recycled to various stages in the process or burned for fuel. A liquid/solid slurry is passed via line 36 through a distillation and solid-liquid separation system 38 where a plurality of streams are obtained; namely: (a) light distillates (up to 400° boiling point), (b) distillate (boiling from about 350°-1050° F.), (c) solvent refined coal (initial boiling point about 850° F.) plus recycle solvent and (d) solid residue containing predominately ash and unconverted coal plus some SRC and solvent. The recycle solvent stream is recycled via line 40 to the coal feed to help make the initial coal/recycle solvent slurry.

Figure 2:
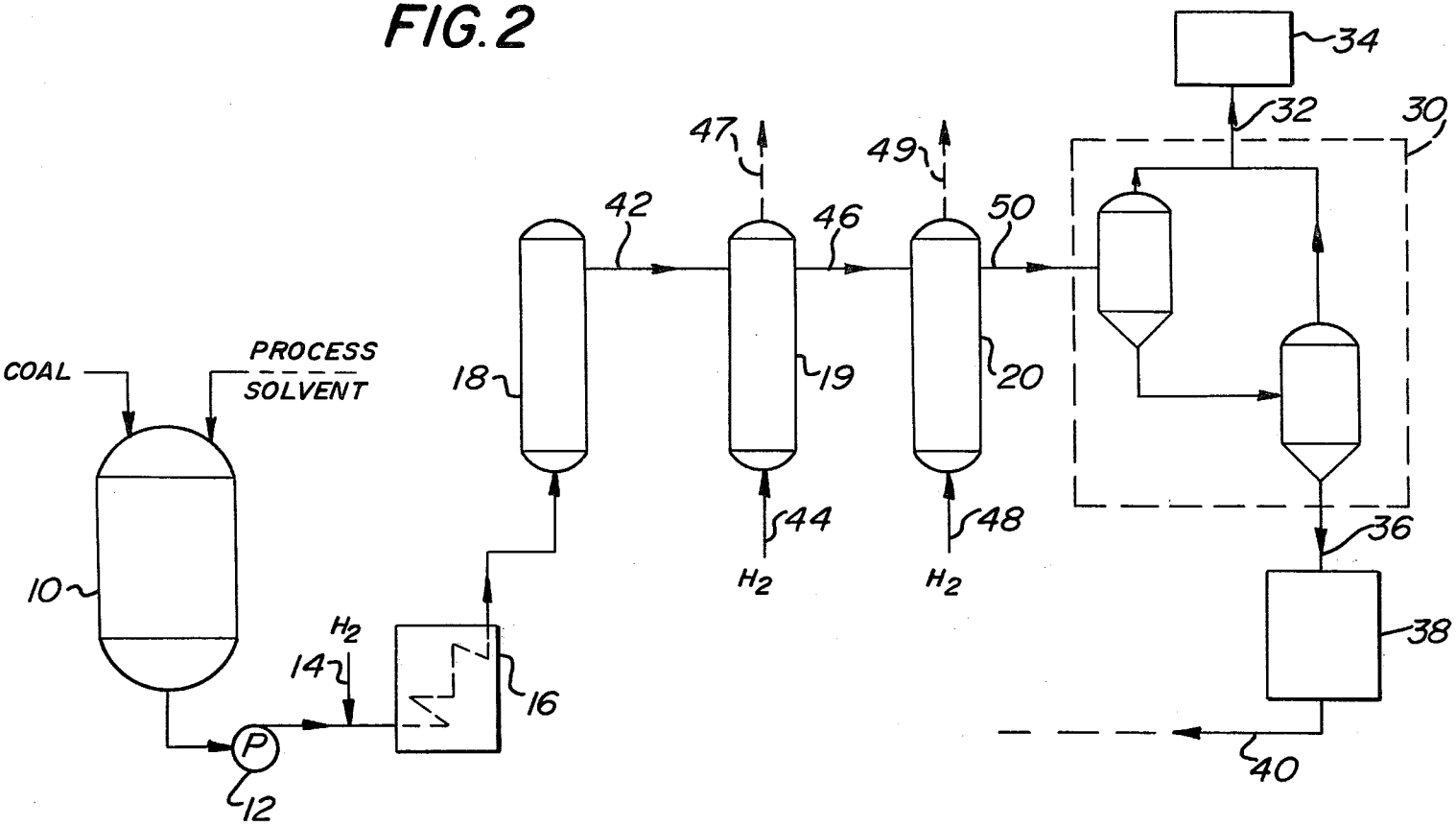
FIG. 2 is a schematic flow diagram of a second embodiment of the invention.

In FIG. 2 there is shown an embodiment of the invention similar to that shown in FIG. 1 wherefore corresponding parts have been given like reference numerals. In this embodiment of the invention, the feed slurry enters the process in the same manner as described above with respect to the FIG. 1 embodiment with the slurry passing to pump 12 from tank 10 and through the preheater 16 from which the heated slurry enters the first dissolver 18. The operational features incorporated in the dissolver 18 of the FIG. 1 embodiment are also applicable in the case of the FIG. 2 embodiment. However, the effluent from the first dissolver vessel 18 does not pass to a gas separator but, instead, passes thorugh a line 42 to the top of the second dissolver vessel 19 where the gases dissengage from the slurry and pass on to the next downstream dissolver 20 via line 46. Because of the turbulence in the second dissolver vessel 19, the disengaged slurry will completely mix with the contents of the second dissolver to produce a backmixing effect which serves to keep a uniform mixture in the vessel while tending to control the exothermic reaction of the hydrocarbon molecules with the molecular hydrogen. Fresh hydrogen is continually added to the second dissolver vessel 19 by way of line 44 which causes a high degree of turbulence in the dissolver vessel 19 to thereby cause the liquid in the vessel to be completely dispersed. Fresh hydrogen is also continuously added to the third dissolver vessel 20 by way of line 48 to create the necessary turbulence within the dissolver vessel 20.

The effluent from the third dissolver 20 is removed and fed through line 50 into the vapor/liquid separating zone 30 where the effluent is treated in the same manner as described above with respect to FIG. 1.

Figure 3:
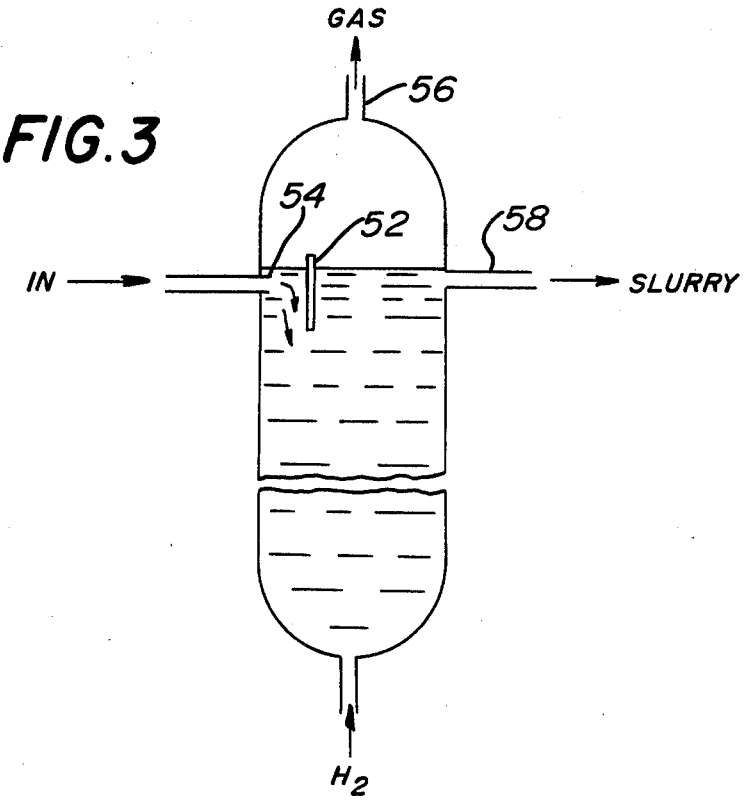
FIG. 3 is a detailed view of a dissolver design.

In a modified version of the FIG. 2 embodiment, the gases disengaged from the slurry may be fed directly from the top of dissolvers 19 and 20 to separate product handling equipment via lines 47 and 49, respectively. In this case a modified type of dissolver design is employed for use in the dissolvers 19 and 20, such dissolver design being shown in FIG. 3. In this dissolver design, a baffle plate 52 is used in such a way that the flow entering the dissolver vessel through inlet pipe 54 will not flow directly to the exit line leaving the vessel. The purpose of baffle plate 52 is to divert flow and may be of any design commonly known to those skilled in the art. Alternatively, the dissolver design shown in FIG. 3 could be modified so that inlet pipe 54 is constructed and arranged to direct the inlet flow in a downward direction so as not to flow directly toward the outlet of the vessel. This modification eliminates the need for baffle plate 52.

Further, the gaseous phase is separated from the liquid phase at the top of the dissolver, the gases being discharged through line 56 and the slurry being discharged through line 58. Thus, the hydrogen, light hydrocarbon gases and a large portion of the solvent range distillate is passed overhead to separate product handling equipment and the condensed slurry phase, which is essentially free of light gases and lighter distillate components, is passed downstream to the next stage of the process.

Figure 4:
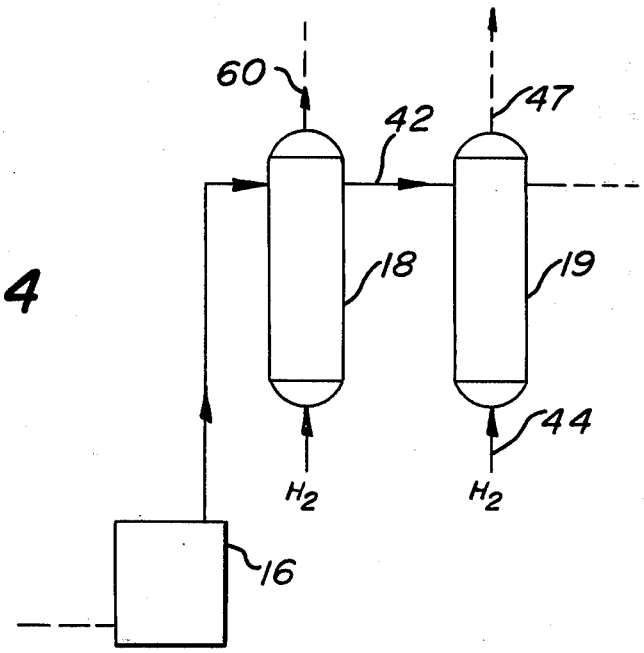
FIG. 4 is a schematic flow diagram of a third embodiment of the invention.

Another modification of the process shown in FIG. 2 is shown in FIG. 4. In this modified process, the effluent from the preheater 16 is passed into the top of the first dissolver 18 where gaseous material, as well as a large fraction of the distillate range recycle solvent, is passed immediately overhead and to downstream product handling facilities by way of line 60. The backmixed condition of the slurry phase will remain a completely uniform mixture of liquid phase reactants within the dissolver. Because there heavier fractions are separated from the lighter distillate material their average residence time will increase for the same equivalent dissolver design. Likewise, the ash accumulation within the dissolver will also be greater than in the dissolver having a bottom inlet for the slurry phase. Further, in the early stages of coal liquefaction, a considerable amount of water is produced by the extensive ether oxygen linkages that are broken by an apparent free radical process. This water severely diminishes the partial pressure of hydrogen in the downstream reactions that occur in the dissolver. Since this water is largely produced in the preheating stage, its removal from the later stages greatly improves the hydrogenation processes that occur.

In order to satisfy the hydrogen demand of the process, much of the hydrogen requirements are fed directly into the dissolver stage bypassing the preheater. Only part of the hydrogen will be fed to the preheater stage.

The process in accordance with the invention shown in FIG. 2 has several important benefits. First, the need for a separate separator vessel is eliminated as is the need to reheat any condensed underflow of an outside separator effluent before re-injecting it into a downstream vessel. Further, the instantaneous countercurrent flow of slurry and hydrogen gas in the second dissolver, for example, will result in lower $H_2S$ partial pressure and thereby improve sulfur removal. Also, in applications employing means for dispersing gas slugs, such as distributor plates or deflectors, the feeding of slurry at any position above this dispersing means eliminates the potential problems associated with passing slurries through such dispersing means, such as, corrosion, or the maldistribution of the gas and slurry phases.

It will be appreciated that the above description is schematic and recites the essentail operation of the process and that those skilled in the art will know where to supply and how to employ the necessary valves, pumps, pressure equipment and other standard engineering elements required in the system.

The invention will now be illustrated by reference to the following Examples, it being understood that these examples are illustrative only and are not intended to be limitative. Several Examples are presented showing application of this process:

| Examples | Description |
|---|---|
| 1 | Four reactors of identical size and void volume in each reactor equal to 8% |
| 2 | Four reactors of identical size and void volume in each reactor equal to 12% |
| 3 | Two reactors of unequal size with the same hydrogen/coal ratio in each |
| 4 | Two reactors of unequal size with different hydrogen/coal ratios in |

-continued

| Examples | Description |
|---|---|
| | each reactor |

EXAMPLE 1

A coal liquefaction plant having capacity of handling 1,000 tons of coal per day through four dissolvers of equal volume, each fed with fresh hydrogen, is described in Table 1. Coal slurried in process solvent at a level of 40% is fed through a preheater and into a dissolver as shown in FIG. 1. This dissolver, having a specified void volume of 8 percent, has a superficial gas rate of 0.11 feet per second. The feed gas is equally distributed between the four dissolvers, the four having a total slurry residence time equal to 30 minutes. The gas feed rate to achieve this void volume at reactor conditions for each dissolver is 2350 cubic feet per 30 minutes. This translates into individual dissolvers having a cross sectional area of 11.9 square feet, a height of 36.6 feet and a diameter of 3.9 feet. Under such conditions the slurry superficial velocity is 0.08 feet per second.

EXAMPLE 2

This example illustrates a coal feed, residence time and hydrogen feed rate for four dissolvers the same as in Example 1 but at a void volume of 0.12. Data are shown in Table 1. The reactor size to accomplish this design criteria would be a diameter of 2.9 feet with a height of 67 feet. Such a system would have a superficial linear gas velocity of 0.20 feet per second.

EXAMPLE 3

A plant size of 1,000 T/D with a hydrogen feed rate requirement of 20 Mscf/ton of coal and a residence time of 30 minutes at a coal concentration of 40% in process solvent could be designed to have two reactors of void volumes of 8 and 12 percent at a reactor volume ratio of 1 to 2. The residence time in the second reactor would be twice that in the first reactor. These specifications require, therefore, that the respective linear gas velocities for the two reactors be 0.11 and 0.20 feet per second for No. 1 and No. 2 dissolvers. These specifications thereby set the size of the dissolvers as shown in Table 1. The height of dissolver 1 and 2 are 36.6 and 66.7 feet, respectively, with the diameters being nearly the same.

EXAMPLE 4

A plant size of 1,000 T/D with a hydrogen feed rate requirement of 20 Mscf/ton of coal and a residence time of 30 minutes at a coal concentration of 40% in process solvent is designed to have two reactors having equal superficial residence times. Taking advantage of higher hydrogen partial pressures in the downstream dissolvers the hydrogen is distributed between the first and second dissolvers in a ratio of 1 to 2. Using equal size reactors as shown in Table 1 the void fractions of the two reactors are 11 and 15%, respectively. Both reactors have a slurry superficial residence time of 15 minutes.

TABLE 1

1,000 T/D Plant Site
20 Mscf $H_2$ Ton Coal
30 Min. Slurry Residence Time
0.71 Gas/Liquid (vol/vol) Ratio
5.6% $H_2$ (based on coal)

| | Example 1 | Example 2 | Example 3 | | Example 4 | |
|---|---|---|---|---|---|---|
| Reactor | 1-4 | 1-4 | 1 | 2 | 1 | 2 |
| Gas Velocity (ft/sec) | 0.11 | 0.20 | 0.11 | 0.20 | .16 | .28 |
| Void Volume (%) | 8 | 12 | 8 | 12 | 11 | 15 |
| Reactor Volume ($ft^3$) | 436 | 436 | 580 | 1160 | 874 | 874 |
| Gas Feed Rate @ Conditions ($ft^3$/30 Min/reactor) | 2350 | 2350 | 3134 | 6268 | 3525 | 5875 |
| Reactor Cross Section ($ft^2$) | 11.9 | 6.5 | 15.8 | 17.4 | 11.9 | 11.9 |
| Reactor Height (ft) | 36.6 | 67 | 36.6 | 66.7 | 73.2 | 73.2 |
| Reactor Diameter (ft) | 3.9 | 2.9 | 4.5 | 4.7 | 3.9 | 3.9 |
| Superficial Slurry Velocity (ft/sec) | 0.08 | 0.15 | 0.06 | 0.06 | 0.08 | 0.08 |

Figure 5:
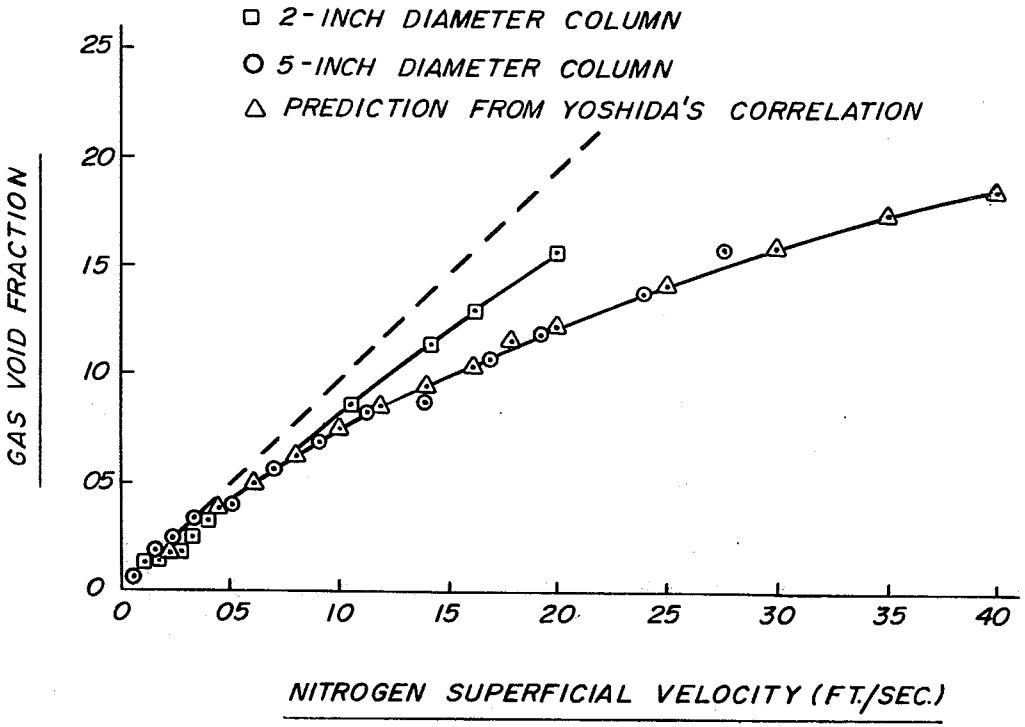
FIG. 5 is a graph showing the relationship between "VOID FRACTION" and "SUPERFICIAL VELOCITY" for a dissolver in accordance with the invention.

The support for the void volume range specified herein is presented in FIG. 5 which shows a plot of data taken from studies in a model reactor comprising a transparent container of water through which nitrogen was passed. In these studies the gaseous void fraction was measured at different nitrogen flow rates which simulate the behavior of gas passing upwardly through a dissolver bed. Curve "A" represents the data for a two inch diameter column and Curve "B" represents data for a five inch diameter column. The points on Curve B indicated by triangles are predictions from what is known as "YOSHIDA's CORRELATION", a technique of correlating experimental data for the fractional gas holdup and the volumetric liquid phase coefficient in gas bubble columns. (See Akita and Yoshida, "Gas Holdup and Volumetric Mass Transfer Coefficient in Bubble Columns", *Ind. Eng. Chem. Process Des. Develop.* Vol. 12, No. 1, 1973, pages 76–80). The dashed line represents an extrapoluation from the initial slope of Curves A and B.

Curve B illustrates that the departure (namely, a reduction from a direct relationship) of void fraction at higher flow rates is very substantial. This substantial departure appears to be a result of the fact that at high flow rates the effective increase in interfacial gas contact with the slurry phase drops off dramatically.

It must be remembered, however, that in the use of dissolvers for coal liquefaction sufficient gas velocity is necessary to adequately suspend the solids within the condensed phase. It has been demonstrated that the solids suspension are most dependent on gas velocity. Therefore, in order to adequately suspend solids, maintain adequate hydrogen mass transfer as well as staying below the high gas velocities that cause unduly high vibrations because of turbulence in the dissolver, void volumes between 8 and 12 volume percent are chosen as the preferred range.

We claim:

1. In a process for the solvent refining of coal wherein a slurry of finely ground coal in process solvent is passed through a preheater to a coal liquefaction stage in the presence of hydrogen-rich gases at elevated temperatures and pressures, the improvement comprising passing the slurry from the preheater in series through a plurality of dissolvers, feeding fresh hydrogen gas to each of said dissolvers, and separating entrained gases from the slurry phase exiting each dissolver and removing said gases from the liquefaction stage, the gas velocity being maintained at a rate to maintain backmix flow in the liquefaction stage so that solids do not settle out therein, and sufficient gas voids being maintained in and sufficient amounts of hydrogen gas being added to said dissolvers so as to insure good hydrogen transfer from the gaseous to the reacting condensed phase.

2. A process according to claim 1 wherein the gas separation step is performed by passing the effluent from each dissolver through a gas separator wherein the gases are separated and a liquid slurry phase is delivered to a downstream dissolver.

3. A process according to claim 1 wherein the gas separation step is performed within the top of said dissolvers by separating the gas phase from the slurry phase and removing each phase from the dissolver in separate streams, the slurry phase exiting each dissolver being fed into the top of a downstream dissolver in said series.

4. A process according to claim 1 wherein the effluent from the preheater is fed into the top of the first dissolver in the series wherein the separation of the gas phase from the slurry phase occurs, the resultant gaseous stream being removed from the top of said first dissolver.

5. A process according to claim 4 wherein fresh hydrogen is passed into the bottom of said first dissolver.

6. A process according to claim 1 wherein fresh hydrogen is passed into each of said dissolvers at the bottom thereof.

7. A process according to claim 1 including maintaining a void volume within each dissolver of between 6 and 15 percent.

8. A process according to claim 7 including maintaining a superficial gas velocity of between 0.11 and 0.25 feet per second.

9. A process according to claim 1 wherein the slurry fed into each downstream dissolver is directed to be incorporated into the backmix flow.

10. A process according to claim 9 wherein the slurry fed into the downstream dissolvers is directed away from the location whereat the slurry exits said dissolvers to thereby effect uniform mixing with the condensed phase reactants within the dissolver by a backmixing action.

11. A process according to claim 1 wherein a void volume of 8–12 percent is maintained within each dissolver.

12. A process according to claim 1 wherein gases contained in the effluent from the preheater are removed from the process prior to entry into the liquefaction reaction.

* * * * *